US011383883B2

(12) United States Patent
Choi

(10) Patent No.: US 11,383,883 B2
(45) Date of Patent: Jul. 12, 2022

(54) PORTABLE BEVERAGE CONTAINER INCLUDING PORTION PACK AND FIXING CAP

(71) Applicant: ROYALGREENS CO., LTD., Seongnam-si (KR)

(72) Inventor: Jee Lim Choi, Gwangju-si (KR)

(73) Assignee: ROYALGREENS CO., LTD., Seongnam-si (KR)

( * ) Notice: Subject to any disclaimer, the term of this patent is extended or adjusted under 35 U.S.C. 154(b) by 365 days.

(21) Appl. No.: 16/496,637

(22) PCT Filed: Mar. 5, 2018

(86) PCT No.: PCT/KR2018/002568
§ 371 (c)(1),
(2) Date: Sep. 23, 2019

(87) PCT Pub. No.: WO2018/174429
PCT Pub. Date: Sep. 27, 2018

(65) Prior Publication Data

US 2020/0377258 A1 Dec. 3, 2020

(30) Foreign Application Priority Data

Mar. 23, 2017 (KR) ..... 10-2017-0036980
Nov. 30, 2017 (KR) ..... 10-2017-0163429

(51) Int. Cl.
*B65D 21/02* (2006.01)
*B65D 85/804* (2006.01)
(Continued)

(52) U.S. Cl.
CPC ..... *B65D 21/0228* (2013.01); *B65D 81/3205* (2013.01); *B65D 85/72* (2013.01); *B65D 85/808* (2013.01); *B65D 85/8061* (2020.05)

(58) Field of Classification Search
CPC ..... B65D 21/0228; B65D 85/8061; B65D 81/3205; B65D 85/72; B65D 85/808; A47J 31/005; A47J 31/4403
(Continued)

(56) References Cited

U.S. PATENT DOCUMENTS

2013/0186280 A1* 7/2013 Sekiguchi ..... A47J 31/005 99/287
2014/0048430 A1 2/2014 Giraud

FOREIGN PATENT DOCUMENTS

CN 1259859 A 7/2000
CN 2587795 Y 11/2003
(Continued)

*Primary Examiner* — J. Gregory Pickett
*Assistant Examiner* — Sanjidul Islam
(74) *Attorney, Agent, or Firm* — Novick, Kim & Lee, PLLC; Jae Youn Kim

(57) ABSTRACT

A portable beverage container includes a portion pack and a fixing cap, wherein the portion pack includes a tubular-shaped fastening part having a first screw formed on an outer circumferential surface thereof; and a storage part extending from the fastening part and configured to store a tea bag or a concentrate therein, and the fixing cap includes an inner insertion part disposed by inserting into the fastening part of the portion pack and having a second screw formed on an inner circumferential surface thereof to be screwed with a screw formed at an inlet of a bottled water container; and an outer insertion part extending from an upper end of the inner insertion part parallel thereto and having a third screw formed on an inner circumferential surface thereof to be screwed with the first screw formed on the fastening part of the portion pack.

4 Claims, 5 Drawing Sheets

(51) Int. Cl.
*B65D 81/32* (2006.01)
*B65D 85/72* (2006.01)
*B65D 85/808* (2006.01)

(58) Field of Classification Search
USPC ..... 220/23.83, 203.19, 203.01, 372, 371, 220/367.1; 206/6.1; 215/310
See application file for complete search history.

(56) References Cited

FOREIGN PATENT DOCUMENTS

| | | | | |
|---|---|---|---|---|
| CN | 103391887 | A | | 11/2013 |
| EP | 0230195 | A1 | * | 12/1986 |
| EP | 0230195 | A1 | | 7/1987 |
| EP | 0905049 | A1 | * | 7/1998 |
| EP | 0905049 | A1 | | 3/1999 |
| GB | 2335179 | A | | 3/1998 |
| JP | 2008-295810 | A | | 12/2008 |
| JP | 2011-006088 | A | | 1/2011 |
| JP | 6111205 | B2 | | 4/2017 |
| KR | 10-0812794 | B1 | | 3/2008 |
| WO | 89-00959 | A1 | | 2/1989 |

* cited by examiner

PORTABLE BEVERAGE CONTAINER INCLUDING PORTION PACK AND FIXING CAP

TECHNICAL FIELD

The present invention relates to a portion pack storing coffee, herbal tea, or the like that can be drunk by diluting it with water.

BACKGROUND ART

Recently, a portion pack, which stores coffee, herbal tea, or the like that can be drunk by diluting it with water according to consumer's preference, is known in the art. Usually, the portion pack is configured to store a liquid concentrate and allow a drinker to drink by diluting it with water stored in a separate container.

Meanwhile, there is an inconvenience in the portion pack since the liquid concentrate stored therein should be poured in a separate container then diluted with water. For this reason, the drinker should provide a separate container for diluting the concentrate stored in the portion pack, and the concentrate may flow out to contaminate the surroundings, which causes inconvenience in use.

In addition, even though there is a proper amount of water for drinking the concentrate stored in a disposable portion pack, it is always difficult for the drinker to adjust the proper amount of water. In particular, herbs or medicinal plants containing medicinal ingredients are being spotlighted as caffeine-free health ingredients. In order to safely drink these herbs or medicinal plants and obtain their efficacy, it is necessary for the drinker to accurately add the proper amount of water.

SUMMARY OF INVENTION

Problems to be Solved by Invention

In consideration of the above-mentioned circumstances, it is an object of the present invention to provide a portable beverage container which is easy to carry, allows a drinker to drink using a commercially available bottled water, and may be stably supported even when placing the container by turning upside down after fastening with a bottled water container, and thereby, the drinker may conveniently use a liquid concentrate or solid tea bag product stored therein.

In addition, another object of the present invention is to provide a fixing cap for a portion pack, which is designed to be fastened to the portion pack, and may prevent a sealing material for sealing an upper portion of the fixing cap from being peeled-off due to changes in a temperature during distribution.

Further, another object of the present invention is to provide a fixing cap for a portion pack, in which a liquid stored in the portion pack may smoothly flow even when using herbs in particular, while improving the convenience of a user when drinking a beverage using a portable beverage container.

The objects of the present invention are not limited to those described above, and other objects not described in this disclosure will be clearly understood to those skilled in the art by reading the following description.

Means for Solving Problems

To achieve the above objects, according to an aspect of the present invention, there is provided a portable beverage container including: a portion pack which includes: a tubular-shaped fastening part having a first screw formed on an outer circumferential surface thereof; and a storage part extending from the fastening part and configured to store a tea bag or a concentrate therein; and a fixing cap which includes: an inner insertion part disposed by inserting into the fastening part of the portion pack and having a second screw formed on an inner circumferential surface thereof to be screwed with a screw formed at an inlet of a bottled water container; and an outer insertion part extending from an upper end of the inner insertion part parallel thereto and having a third screw formed on an inner circumferential surface thereof to be screwed with the first screw formed on the fastening part of the portion pack, wherein the inner insertion part is disposed inside the outer insertion part, and a region of the outer insertion part having the third screw formed thereon and a region of the inner insertion part having the second screw formed thereon are disposed to be overlapped with each other on a plane orthogonal to a vertical line V passing through a center of the inner insertion part and the outer insertion part.

In the above-described portable beverage container, the fixing cap may further include a filter part disposed at a lower end of the inner insertion part. In addition, the fixing cap may further include a sleeve spaced apart from an inner circumferential surface of the inner insertion part having the second screw formed thereon and inserted into the inlet of the bottled water container. Further, the portion pack is preferably formed symmetrically about at least one plane including the vertical line V.

According to another aspect of the present invention, there is provided a fixing cap configured to fasten a portion pack which includes: a tubular-shaped fastening part having a first screw formed on an outer circumferential surface thereof; and a storage part extending from the fastening part and configured to store a tea bag or a concentrate therein, to a bottled water container.

Herein, the fixing cap may include: an inner insertion part disposed by inserting into the fastening part of the portion pack and having a second screw formed on an inner circumferential surface thereof to be screwed with a screw formed at an inlet of the bottled water container; and an outer insertion part extending from an upper end of the inner insertion part parallel thereto and having a third screw formed on an inner circumferential surface thereof to be screwed with the first screw formed on the fastening part of the portion pack, wherein the inner insertion part is disposed inside the outer insertion part, and a region of the outer insertion part having the third screw formed thereon and a region of the inner insertion part having the second screw formed thereon are disposed to be overlapped with each other on a plane orthogonal to a vertical line V passing through a center of the inner insertion part and the outer insertion part.

The above-described fixing cap may further include a filter part disposed at a lower end of the inner insertion part.

In addition, the fixing cap may further include a sleeve spaced apart from an inner circumferential surface of the inner insertion part having the second screw formed thereon and inserted into the inlet of the bottled water container.

According to another aspect of the present invention, there is provided a fixing cap configured to fasten a portion pack which includes: a tubular-shaped fastening part having a first screw formed on an outer circumferential surface thereof; and a storage part extending from the fastening part and configured to store a tea bag or a concentrate therein, to a bottled water container, the fixing cap including: an inner insertion part disposed by inserting into the fastening part of the portion pack and having a second screw formed on an inner circumferential surface thereof to be screwed with a screw formed at an inlet of the bottled water container; an outer insertion part extending from an upper end of the inner insertion part parallel thereto and having a third screw formed on an inner circumferential surface thereof to be screwed with the first screw formed on the fastening part of the portion pack; and a filter part disposed at a lower end of the inner insertion part and providing with a plurality of through holes formed therein, wherein stepped portions are formed on circumferences of the through holes.

Herein, the stepped portions formed on the circumferences of the through holes are preferably arranged so that respective directions of centers of curvature thereof are different from each other.

In addition, the plurality of through holes are preferably formed to have a diameter of 2 mm or more.

Further, a groove is preferably formed between an upper end of the inner insertion part and an upper end of the outer insertion part.

Furthermore, the upper end of the inner insertion part and the upper end of the outer insertion part may be formed at the same height as each other.

Advantageous Effects

In accordance with the portable beverage container according to the present invention, it is convenient to drink various herbs and medicinal plants by diluting with water, by using a disposable bottled water which is readily available in the market. In particular, the portion pack according to the present invention may be manufactured so as to contain an amount of liquid suitable for a variety of herbs and medicinal plants, such that a drinker may easily adjust the amount of water suitable for drinking and obtaining the efficacy of such herbs and medicinal plants during using. In addition, when using the fixing cap according to the present invention, even if the container is placed by turning upside down after fastening the portion pack with the bottled water container, the drinker may more conveniently drink a tea bag or a concentrate stored in the storage part by diluting it with water.

BEST MODE FOR CARRYING OUT INVENTION

Figure 1:
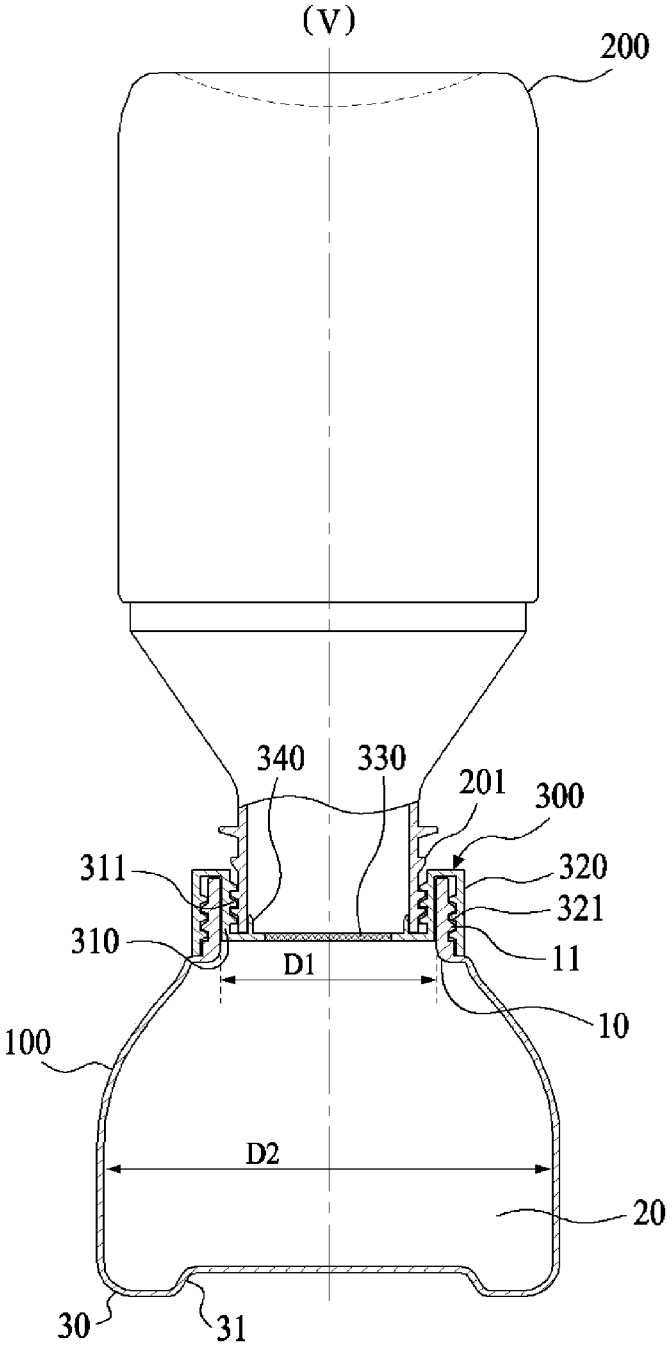
FIG. 1 is a cross-sectional view illustrating a state in which a portable beverage container according to an embodiment of the present invention is coupled to a bottled water container.

According to an aspect of the present invention, there is provided a portable beverage container including: a portion pack which includes: a tubular-shaped fastening part having a first screw formed on an outer circumferential surface thereof; and a storage part extending from the fastening part and configured to store a tea bag or a concentrate therein; and a fixing cap which includes: an inner insertion part disposed by inserting into the fastening part of the portion pack and having a second screw formed on an inner circumferential surface thereof to be screwed with a screw formed at an inlet of a bottled water container; and an outer insertion part extending from an upper end of the inner insertion part parallel thereto and having a third screw formed on an inner circumferential surface thereof to be screwed with the first screw formed on the fastening part of the portion pack, wherein the inner insertion part is disposed inside the outer insertion part, and a region of the outer insertion part having the third screw formed thereon and a region of the inner insertion part having the second screw formed thereon are disposed to be overlapped with each other on a plane orthogonal to a vertical line V passing through a center of the inner insertion part and the outer insertion part.

In the above-described portable beverage container, the fixing cap may further include a filter part disposed at a lower end of the inner insertion part. In addition, the fixing cap may further include a sleeve spaced apart from an inner circumferential surface of the inner insertion part having the second screw formed thereon and inserted into the inlet of the bottled water container. Further, the portion pack is preferably formed symmetrically about at least one plane including the vertical line V.

According to another aspect of the present invention, there is provided a fixing cap configured to fasten a portion pack which includes: a tubular-shaped fastening part having a first screw formed on an outer circumferential surface thereof; and a storage part extending from the fastening part and configured to store a tea bag or a concentrate therein, to a bottled water container.

Herein, the fixing cap may include: an inner insertion part disposed by inserting into the fastening part of the portion pack and having a second screw formed on an inner circumferential surface thereof to be screwed with a screw formed at an inlet of the bottled water container; and an outer insertion part extending from an upper end of the inner insertion part parallel thereto and having a third screw formed on an inner circumferential surface thereof to be screwed with the first screw formed on the fastening part of the portion pack, wherein the inner insertion part is disposed inside the outer insertion part, and a region of the outer insertion part having the third screw formed thereon and a region of the inner insertion part having the second screw formed thereon are disposed to be overlapped with each other on a plane orthogonal to a vertical line V passing through a center of the inner insertion part and the outer insertion part.

The above-described fixing cap may further include a filter part disposed at a lower end of the inner insertion part.

In addition, the fixing cap may further include a sleeve spaced apart from an inner circumferential surface of the inner insertion part having the second screw formed thereon and inserted into the inlet of the bottled water container.

According to another aspect of the present invention, there is provided a fixing cap configured to fasten a portion pack which includes: a tubular-shaped fastening part having a first screw formed on an outer circumferential surface thereof; and a storage part extending from the fastening part and configured to store a tea bag or a concentrate therein, to a bottled water container, the fixing cap including: an inner insertion part disposed by inserting into the fastening part of the portion pack and having a second screw formed on an inner circumferential surface thereof to be screwed with a screw formed at an inlet of the bottled water container; an outer insertion part extending from an upper end of the inner insertion part parallel thereto and having a third screw formed on an inner circumferential surface thereof to be screwed with the first screw formed on the fastening part of the portion pack; and a filter part disposed at a lower end of the inner insertion part and providing with a plurality of through holes formed therein, wherein stepped portions are formed on circumferences of the through holes.

Herein, the stepped portions formed on the circumferences of the through holes are preferably arranged so that respective directions of centers of curvature thereof are different from each other.

In addition, the plurality of through holes are preferably formed to have a diameter of 2 mm or more.

Further, a groove is preferably formed between an upper end of the inner insertion part and an upper end of the outer insertion part.

Furthermore, the upper end of the inner insertion part and the upper end of the outer insertion part may be formed at the same height as each other.

MODE FOR CARRYING OUT INVENTION

The present invention may be altered in various ways and have various embodiments, and will be described with reference to the drawings for illustrating specific embodiments. However, the present invention is not limited to the specific embodiments, and it will be understood by those skilled in the art that the present invention is to cover all modifications, equivalents, and alternatives falling within the spirit and scope of the present invention. Further, in description of preferred embodiments of the present invention, the publicly known functions and configurations that are judged to be able to make the purport of the present invention unnecessarily obscure will not be described in detail.

First, as illustrated in FIG. 1, the portable beverage container according to the present invention may include a portion pack 100 and a fixing cap 300.

Herein, the portion pack 100 may include a fastening part 10 and a storage part 20.

The fastening part 10 is formed in a tubular shape with a circular cross section, and has a first screw 11 formed on an outer circumferential surface thereof to be fastened to a bottled water container 200 through a fixing cap 300 which will be described below. In addition, the storage part 20 forms a space in which a tea bag or a concentrate can be stored.

The storage part 20 is formed to have a larger diameter than a diameter of the fastening part 10, and preferably has a shape which extends from the fastening part 10 with an increased diameter toward a bottom thereof. In particular, the portion pack 100 may be manufactured by a blow molding method for mass production. The blow molding method refers to a method including preforming a raw material in a tube shape by extrusion or injection, then inserting the same into a mold and blowing air into the mold to be billowed, followed by cooling and solidifying the same to prepare a solid product having a specific form. The portion pack 100 according to the present invention may be manufactured by preparing the solid product in the blow molding method as described above, then forming the first screw 11 on the outer circumferential surface of the fastening part 10. When manufacturing the portion pack 100 by the blow molding method as described above, a production speed and production costs of the product may be reduced. On the other hand, when using a typical injection molding method, since a screw should be formed on an inner surface of the portion pack 100, the production speed of the product is reduced and the production costs are significantly increased.

Figure 2:
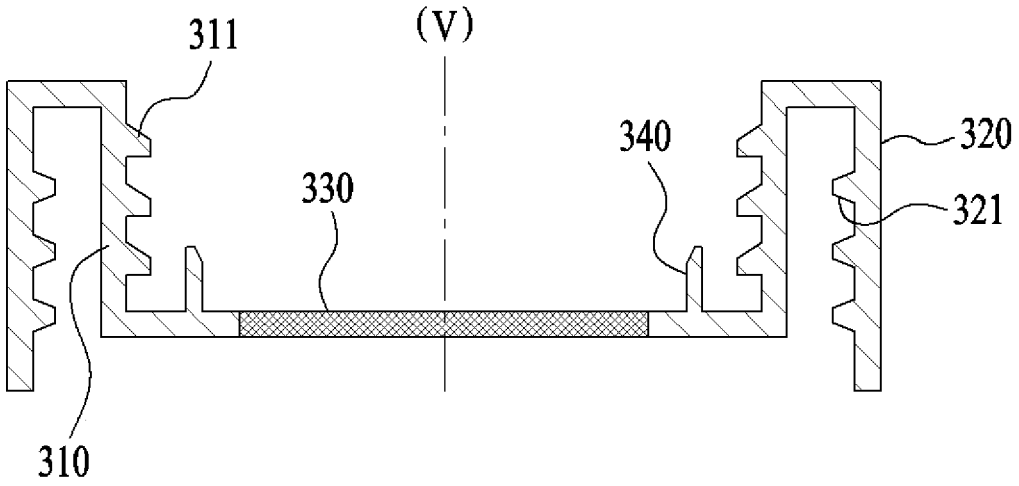
FIG. 2 is a cross-sectional view of a fixing cap according to the present invention.

Meanwhile, as illustrated in FIGS. 1 and 2, the fixing cap 300 according to the present invention includes: an inner insertion part 310 disposed by inserting into the fastening part 10 of the portion pack 100 and having a second screw 311 formed on an inner circumferential surface thereof to be screwed with a screw 201 formed at an inlet of the bottled water container 200; and an outer insertion part 320 extending from an upper end of the inner insertion part 310 parallel thereto and having a third screw 321 formed on an inner circumferential surface thereof to be screwed with the first screw 11 formed on the fastening part 10 of the portion pack 100. Herein, the inner insertion part 310 is formed in a tubular shape with a circular cross section having an inner diameter of a dimension enough to be fitted to an outer diameter of the inlet of the bottled water container 200. The outer insertion part 320 extending from the upper end of the inner insertion part 310 parallel thereto is formed so that the inner insertion part 310 is disposed therein, and is formed in a tubular shape with a circular cross section having an inner diameter of a dimension enough to be fitted to an outer diameter of the fastening part 10 of the portion pack 100.

When using the portable beverage container according to the invention, as illustrated in FIG. 1, first, the first screw 11 formed on the fastening part 10 of the portion pack 100 is screwed with the third screw 321 formed on the outer insertion part 320 of the fixing cap 300. At this time, the outer insertion part 320 and the inner insertion part 310 are configured so that a region of the outer insertion part 320 having the third screw 321 formed thereon and a region of the inner insertion part 310 having the second screw 311 formed thereon are disposed to be overlapped with each other on a plane orthogonal to a vertical line V passing through a center of the inner insertion part 310 and the outer insertion part 320 (i.e., as viewed from a side). In particular, the fastening part 10 of the portion pack 100 is inserted between the outer insertion part 320 and the inner insertion part 310 to be firmly fixed by screwing of the first screw 11 with the third screw 321.

Thereafter, the second screw 311 provided at the inner insertion part 310 of the fixing cap 300 is screwed with the screw 201 provided at the inlet of the bottled water container 200. At this time, a sleeve 340 formed in the fixing cap is inserted into the inlet of the bottled water container 200 to be firmly fixed. The sleeve 340 may be formed to be spaced apart from the inner circumferential surface of the inner insertion part having the second screw 311 formed thereon with a gap corresponding to a thickness of the inlet of the bottled water container. By the sleeve 340, the fixing cap 300 and the bottled water container 200 may be more firmly fastened with each other. In addition, since the sleeve 340 is inserted and disposed in the inlet of the bottled water container 200, when placing the portion pack 100 and the bottled water container 200 which are fastened to each other through the fixing cap 300 by turning upside down as illustrated in FIG. 1, bottled water (not illustrated) contained in the bottled water container 200 is guided so as to inflow into the storage part 20 through the fastening part 10.

Meanwhile, since the screw 201 formed on the outer circumferential surface of the inlet of the general bottled water container 200 is formed as a right-handed male screw, the second screw 311 formed on the inner circumferential surface of the inner insertion part 310 is preferably formed as a right-handed female screw that can be screwed with the screw 201. In addition, the first screw 11 formed on the outer circumferential surface of the fastening part 10 of the portion pack 100 may also be formed as a right-handed male screw, and the third screw 321 formed on the inner circumferential surface of the outer insertion part 320 may be formed as a right-handed female screw that can be screwed with the first screw 11. When forming both the second screw 311 and the third screw 321 as the right-handed screws, the outer insertion part 320 of the fixing cap 300 is first fastened to the portion pack 100, and then the inner insertion part 310 of the fixing cap 300 is inserted into the inlet of the bottled water container 200 again, thereby the fastening processes may be performed smoothly.

As illustrated in FIG. 1, in a state in which the portion pack 100, the fixing cap 300 and the bottled water container 200 are fastened, when turning upside down so that the portion pack 100 is placed on a downside, the bottled water stored in the bottled water container 200 inflows into the storage part 20 through the fastening part 10. Thereby, the tea bag or the concentrate stored inside the storage part 20 is diluted with water. When using the portable beverage container in this manner, a drinker maintains the state as illustrated in FIG. 1 for a considerably long time so that the tea bag or the concentrated is sufficiently diluted with water. In this case, a bottom surface 30 of the portion pack 100 may be formed to have a sufficient diameter so that a state, in which the bottled water container 200 is placed upside down, is safely maintained. In addition, since the storage part 20 has a diameter D2 which is formed larger than a diameter D1 of the fastening part 10, a larger amount of liquid is present on the storage part 20 side than the fastening part 10 side, such that a center of gravity is on the storage part 20 side. Therefore, the state in which the bottled water container 200 is placed upside down may be safely maintained. At this time, the storage part 20 may be manufactured in a shape in which the diameter D2 thereof is gradually increased toward a bottom section 30 from the fastening part 10. In this case, a section between the fastening part and the storage part 20 in a vertical direction is formed to be inclined, such that flowability of the concentrate flowing to the bottled water container 200 side may be improved.

In addition, when using the fixing cap 300 according to the present invention, the state, in which the bottled water container 200 is placed upside down, may be more stably maintained. That is, since the outer insertion part 320 fastened to the portion pack 100 and the inner insertion part 310 fastened to the bottled water container 200 are disposed to be overlapped with each other on the plane orthogonal to the vertical line V, the center of gravity of the entire container is lowered.

In addition, when placing the portion pack 100 fastened to the bottled water container 200 by turning upside down (i.e., when placing so that the portion pack 100 is disposed below), in order to maintain the placed state of the entire container in balance, it is preferable that the portion pack 100 is formed symmetrically about at least one plane including the vertical line V.

Meanwhile, the fixing cap 300 according to the present invention may further include a filter part 330 disposed at a lower end of the inner insertion part 310. The filter part 330 prevents the tea bag or a solid material of the concentrate stored in the portion pack 100 from being introduced into the bottled water container 200, and also prevents foreign matters stored in the bottled water container 200 from being introduced into the portion pack 100.

However, it is preferable that the liquid bottled water, the concentrate, or a diluent may inflow into an opposite side via the filter part 330.

In addition, it is preferable that the portion pack 100 has a recess 31 formed in the bottom section 30 thereof so that different portion packs may be stacked on each other. In this case, the recess 31 may be formed to have an inner diameter substantially matching with an outer diameter of the upper end of the fastening part of another portion pack or an outer diameter of the outer insertion part 320 of the fixing cap 300. When using the recess 31, a plurality of portion packs having the fixing cap 300 fastened thereto or without the fixing cap fastened thereto may be stacked and stored.

Using the above-described portable beverage container has the following advantages.

First, since the portion pack may be manufactured by selecting a volume of the storage part depending on various herbs and herbal ingredients, the drinker may use by pouring water into the portion pack 100 according to the present invention based on the selected volume, thereby easily adjusting the proper amount of water.

Second, since the portable beverage container according to the present invention may be used by fastening with a disposable bottled water container which is readily available in the market, the drinker may use the beverage container according to the present invention while carrying only the same without a need to provide a separate container.

Third, the portable beverage container according to the present invention may be used as a stopper by fastening with the bottled water, and may also be used as a cup for drinking a portion of the beverage. In particular, when placing the portable beverage container with being fastened to the bottled water container 200 by turning upside down, by designing the container to sufficiently support a weight of the bottled water container, and designing the center of gravity of the entire container disposed upside down to be lowered, it is possible to more safely use the container.

Fourth, since the portion pack forming the portable beverage container according to the present invention is designed to be manufactured by using blow molding not the typical injection or extrusion, a production process of the product is simpler and the manufacturing costs thereof may be further reduced.

Next, a portion pack forming a portable beverage container according to another embodiment of the present invention and a fixing cap used therein will be described with reference to FIGS. 3 to 5.

Figure 5:
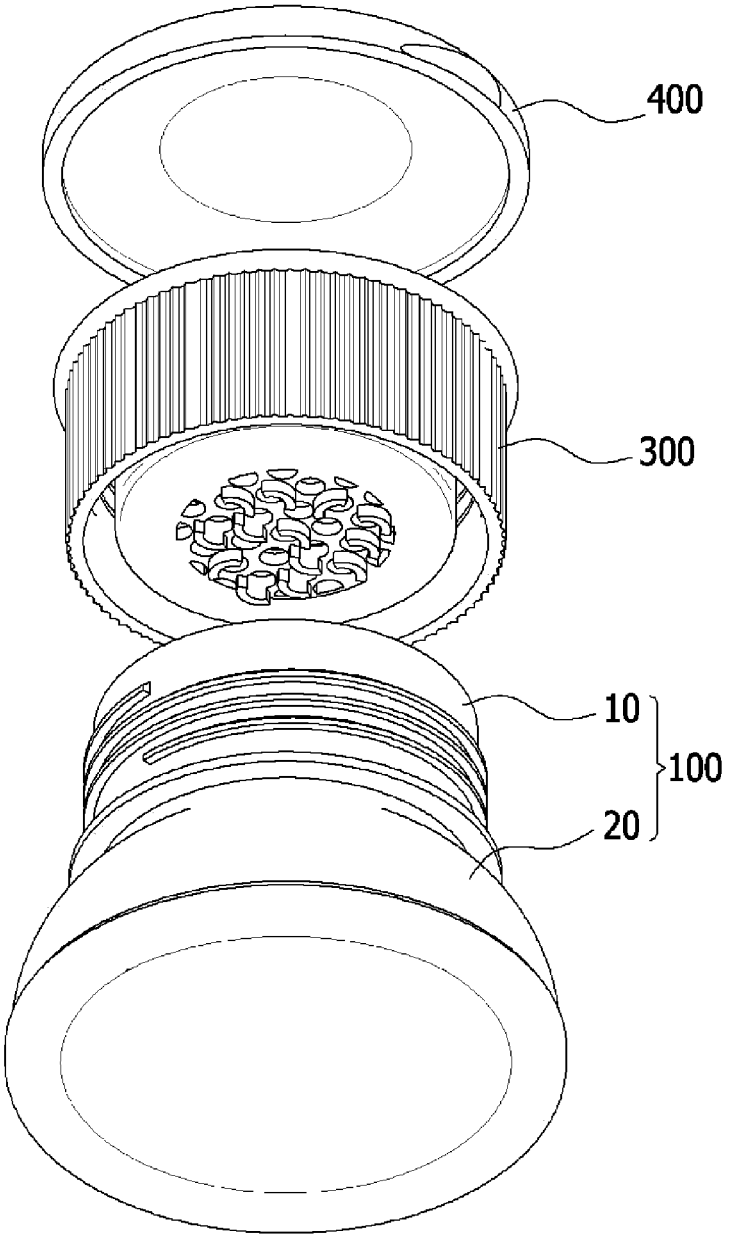
FIG. 5 is a schematic perspective view illustrating an example of a portable beverage container according to the present invention.

As illustrated in FIG. 5, the portable beverage container according to another embodiment of the present invention may include a portion pack 100 provided with a fastening part 10 and a storage part 20, a fixing cap 300 configured to be used by fastening with the bottled water container, and a cover 400 configured to seal an upper portion of the fixing cap 300.

Figure 3:
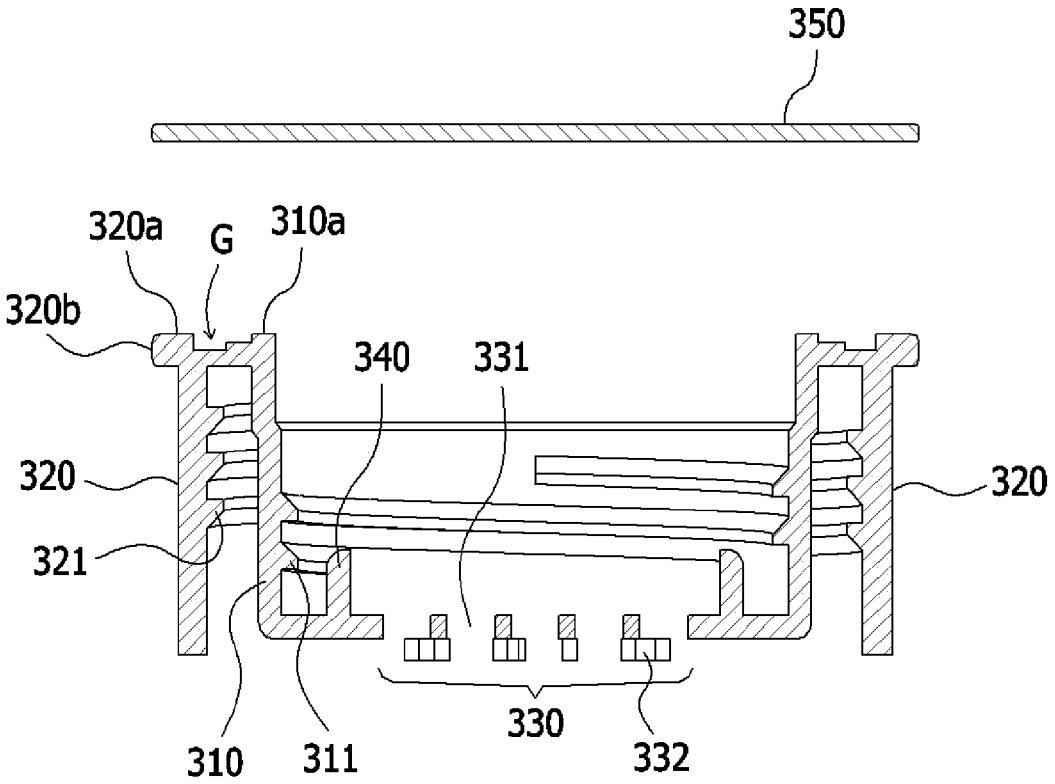
FIG. 3 is a cutaway view of a fixing cap according to another embodiment of the present invention.
Figure 4:
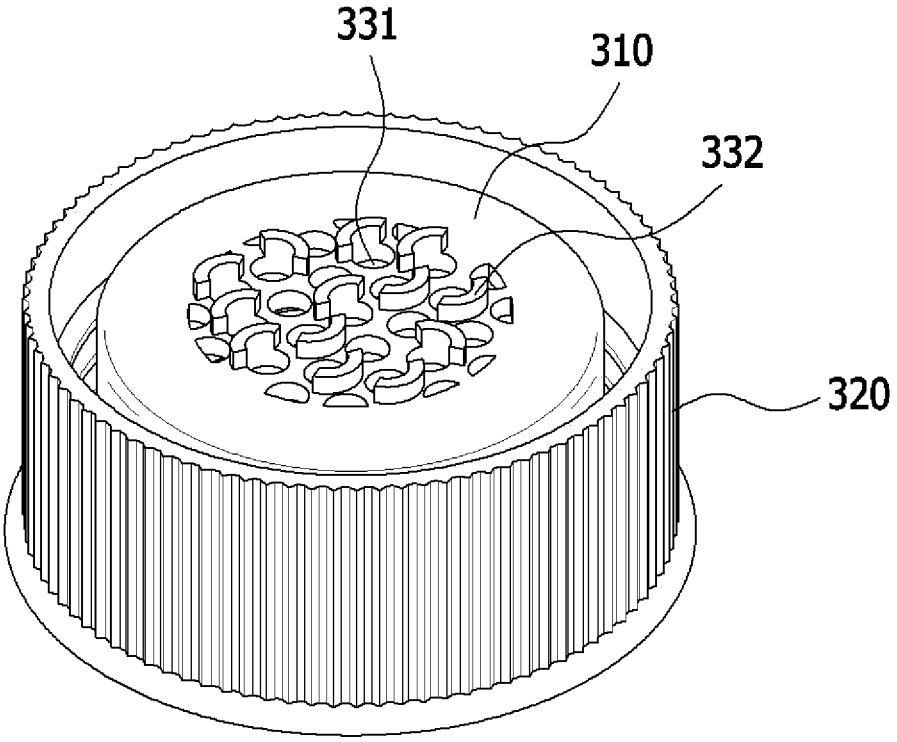
FIG. 4 is a perspective view illustrating a lower surface of a fixing cap according to another embodiment of the present invention.

Herein, as illustrated in FIG. 3, the cover 400 may be latched to a latching part **320*b* which laterally protrudes from the upper end 320*a* of the outer insertion part 320**.

Meanwhile, since the container is distributed in a state in which the herb, tea bag, concentrate, or the like is stored in the storage part 20, it is preferable to finish the upper end of the fixing cap 300 with a separate sealing material 350 so as to prevent the contents contained in the storage part 20 from leaking. At this time, the sealing material 350 or the fixing cap 300 may be peeled off while contracting and expanding according to changes in the temperature during the manufacturing process or distribution. As a result, the contents contained in the storage part 20 may leak. In order to prevent this phenomenon, it is preferable to form a space in the upper portion of the fixing cap 300 at a portion thereof in which the sealing material 350 is adhered.

Specifically, in order to prevent the sealing of the sealing material 350 from being released, the sealing material 350 is doubly adhered to the upper end 310*a* of the inner insertion part and the upper end 320*a* of the outer insertion part, respectively.

The upper end 310*a* of the inner insertion part and the upper end 320*a* of the outer insertion part are formed at the same height so that the sealing material 350 is uniformly adhered. A groove G is formed between the upper end 310*a* of the inner insertion part and the upper end 320*a* of the outer insertion part. The groove G may be formed in a circular band shape along the circumference of an upper surface of the fixing cap 300. When forming the groove G as described above, it is possible to effectively prevent the sealing of the sealing material 350 from being released by the contraction or expansion thereof according to the changes in the temperature.

In addition, when using the beverage container according to the present invention, in order to allow the liquid to flow between the bottled water container 200 and the portion pack 100, a plurality of through holes 331 are provided in the filter part 330 formed at the lower surface of the inner insertion part 310. At this time, when fastening the bottled water container 200 to the fixing cap 300, an inner space formed by connecting the portion pack 100 and the bottled water container 200 with each other is sealed. In this state, in order to allow the liquid to smoothly flow toward the portion pack 100 or the bottled water container 200, the through hole 331 needs to have a diameter of 2 mm or more. In addition, in order to maximize a flow rate of the liquid, it is preferable to form the maximum number of the through holes 331 in a given area. That is, as illustrated in FIG. 4, it is preferable to arrange the plurality of through holes 331 in a hexagonal dense structure. In particular, if the plurality of through holes 331 are arranged in the hexagonal dense structure, when a user drinks the beverage in the portion pack 100, the liquid may uniformly flow in all directions.

Meanwhile, the herb may be stored in the storage part 20 such that the through hole 331 formed in the filter part 330 may be blocked by the herb to inhibit the flow of the liquid. In order to prevent this phenomenon, arc-shaped stepped portions 332 may be provided on circumferences of the through holes 331.

Preferably, the stepped portion 332 provided on the circumference of the through hole 331 is formed to have an arc length of about 180 degrees or less, and protrudes outward from the lower surface of the inner insertion part 310 by a predetermined height. When forming the stepped portion 332 as described above, a gap may be maintained due to the height of the stepped portion 332 even if the herb is stuck around the through hole 331, and thereby preventing the through hole 331 from being completely blocked. In particular, it is more effective that the stepped portions 332 respectively formed around the plurality of neighboring through holes 331 are alternately arranged so that respective directions of centers of curvature thereof are different from each other. That is, as illustrated in FIG. 4, by arranging the stepped portions 332 so as to be deviated from each other, it is possible to prevent the through holes 331 from being completely blocked even if the herb is stuck between the neighboring through holes 331.

While the present invention has been described with reference to the preferred embodiments, it will be understood by the person who has a common knowledge in the technical field to which the invention pertains that various modifications and variations may be made therein without departing from the scope of the present invention as defined by the appended claims. Accordingly, the embodiments described in this disclosure should not be construed to limit the technical spirit of the present invention, but should be construed to illustrate the technical spirit of the present invention. The scope of the present invention should be interpreted according to the following appended claims not the above description, and the present invention should be construed to cover all modifications or variations induced from the meaning and scope of the appended claims and their equivalents.

The invention claimed is:

1. A fixing cap configured to fasten a portion pack which comprises: a tubular-shaped fastening part having a first screw formed on an outer circumferential surface thereof; and a storage part extending from the fastening part and configured to store a tea bag or a concentrate therein, to a bottled water container, the fixing cap comprising:

an inner insertion part disposed by inserting into the fastening part of the portion pack and having a second screw formed on an inner circumferential surface thereof to be screwed with a screw formed at an inlet of the bottled water container;

an outer insertion part extending from an upper end of the inner insertion part parallel thereto and having a third screw formed on an inner circumferential surface thereof to be screwed with the first screw formed on the fastening part of the portion pack; and a filter part disposed at a lower end of the inner insertion part and providing with a plurality of through holes formed therein, wherein stepped portions are formed on circumferences of the through holes in a hexagonal dense structure, having an arc length of about 180 degrees or less, and wherein the stepped portions formed on the circumferences of the through holes are arranged so that respective directions of centers of curvature thereof are different from each other.

2. The fixing cap according to claim 1, wherein the plurality of through holes are formed to have a diameter of 2 mm or more.

3. The fixing cap according to claim 1, wherein a groove is formed between the upper end of the inner insertion part and an upper end of the outer insertion part.

4. The fixing cap according to claim 3, wherein the upper end of the inner insertion part and the upper end of the outer insertion part are formed at the same height as each other.

* * * * *